US007128509B2

(12) United States Patent
Farley et al.

(10) Patent No.: US 7,128,509 B2
(45) Date of Patent: Oct. 31, 2006

(54) SHIPPING CARRIER

(75) Inventors: Charles Farley, Ortonville, MI (US); Craig Hefner, Davisburg, MI (US)

(73) Assignee: C & D Enterprises Inc., Auburn Hills, MI (US)

( * ) Notice: Subject to any disclaimer, the term of this patent is extended or adjusted under 35 U.S.C. 154(b) by 60 days.

(21) Appl. No.: 10/894,228

(22) Filed: Jul. 19, 2004

(65) Prior Publication Data

US 2006/0013647 A1 Jan. 19, 2006

(51) Int. Cl.
*B60P 7/06* (2006.01)

(52) U.S. Cl. ..... 410/43

(58) Field of Classification Search ..... 410/43, 410/31, 46

See application file for complete search history.

(56) References Cited

U.S. PATENT DOCUMENTS 3,073,260 A * 1/1963 Dunlap et al. ..... 410/124
5,141,114 A * 8/1992 Cate et al. ..... 211/85.8
5,193,692 A * 3/1993 Farley et al. ..... 211/41.14
5,324,105 A * 6/1994 Christensen ..... 312/319.4
5,379,904 A * 1/1995 Brown ..... 211/85.8
5,584,624 A * 12/1996 DeVoursney ..... 410/143
5,605,239 A * 2/1997 DeVoursney et al. ..... 211/183
5,876,165 A * 3/1999 Campbell ..... 410/43
5,887,718 A * 3/1999 Oslin et al. ..... 206/499
6,568,891 B1 * 5/2003 DeLong ..... 410/43

* cited by examiner

*Primary Examiner*—H Gutman
(74) *Attorney, Agent, or Firm*—Gifford, Krass, Groh, Sprinkle, Anderson & Citkowski, P.C.

(57) ABSTRACT

A shipping carrier having a frame with at least one elongated rectangular tube having an outer periphery. An elongated retainer has dunnage attached to it for supporting the intended load. The retainer is attached to the tube so that the retainer is positioned wholly around the outside of the outer periphery of the tube.

17 Claims, 4 Drawing Sheets

SHIPPING CARRIER

BACKGROUND OF THE INVENTION

I. Field of the Invention

The present invention relates to shipping carriers for components.

II. Description of Related Art

Shipping carriers are oftentimes used to ship manufactured components from the place of manufacture and to their place of assembly. For example, in the automotive industry many of the individual components of the automotive vehicles, such as automotive windshields, are manufactured in one location and then shipped to a different location for their assembly on the automotive vehicle.

With reference to FIG. 2, such shipping containers of the type used in the automotive industry typically include a rigid frame constructed of rectangular metal tubing 20. Furthermore, the metal tubing includes a longitudinally extending slot 22 formed along one of the sides of the tubing.

Thereafter, an elongated retainer 24, typically constructed of plastic and having a T-portion 26 along one side, is slid into the interior of the square metal tubing so that the T-portion 26 of the retainer is entrapped within the interior of the tubing 20. The remainder of the retainer 24 protrudes outwardly through the slot 22 in the tubing 20 and protrudes exteriorly of the tubing 20. The retainer also includes dunnage 28, typically made of urethane or an elastomeric material, which is molded onto the outwardly protruding portion of the retainer 24. This dunnage 28 is specifically designed to accommodate the particular load of the shipping carrier.

These previously known shipping carriers, however, suffer from a number of disadvantages. One disadvantage is that the slotted square metal tubing used to form the frame and hold the retainers is expensive to manufacture and purchase. This, in turn, increases the overall cost of the shipping carrier.

A still further disadvantage of the previously known shipping carriers is that, in order to position the retainer with the attached dunnage into the slotted metal tubing, it is necessary to disassemble the slotted metal tubing from the frame, insert the T-portion of the retainer into the interior of the metal tubing, and thereafter reattach the metal tubing to the frame. This, of course, increases the assembly time and cost of the shipping container as well as the time necessary to convert the shipping container from one type of transported item to a different type of transported item.

SUMMARY OF THE PRESENT INVENTION

The present invention provides a shipping container particularly suited for the automotive industry which overcomes all of the above-mentioned disadvantages of the previously known shipping containers.

In brief, the shipping container of the present invention comprises a frame having at least one elongated metal tube. The metal tube is rectangular in cross-sectional shape but, unlike the previously known shipping carriers, is not slotted along one side and, instead, has a continuous outer periphery.

Dunnage is then molded to an elongated retainer. The elongated retainer includes a main body portion which is dimensioned to be positioned against the outer periphery of the metal tube. The retainer is then detachably secured to the metal tube such that the retainer is positioned wholly on the outside of the metal tube.

Any of a number of different ways may be used to secure the retainer to the metal tube. In one embodiment of the invention, the retainer includes a main body having two panels which protrude outwardly through opposite sides of the main body so that the panels are spaced apart and parallel to each other. Furthermore, the retainer is dimensioned so that, with the main body of the retainer positioned flatly along one side of the metal tube, the two panels flatly abut against the adjacent two opposed sides of the metal tube. The retainer is then detachably secured to the metal tube by fasteners, such as screws, which extend through the retainer and into the metal tube. Alternatively, the retainer may be adhesively secured to the outer periphery of the metal tube.

In still a further embodiment of the invention, the retainer is constructed of a flexible material, such as plastic, and an undercut portion is provided along the edge of each panel most spaced from the main body of the retainer. The retainer is then attached to the metal tube by snapping the retainer over the metal tube so that the undercut portions overlie a portion of the metal tube on its side opposed from the main body of the retainer. Screws or other fasteners may also be used to ensure the secure attachment of the retainer to the metal tube.

In still a further embodiment of the invention, the retainer includes a T-slot which is dimensioned to receive the T-portion of a conventional retainer with attached dunnage. In this embodiment, the conventional retainer with dunnage is first attached to the retainer of the present invention and the retainer is thereafter attached to the metal tube.

A primary advantage of the present invention is that standard square metal tubing, rather than the more expensive slotted metal tubing, may be used to form the frame for the shipping carrier. Additionally, the retainer with its attached dunnage may be rapidly attached to the metal tube in order to complete the shipping carrier as well as to modify the shipping carrier to carry different types of components.

BRIEF DESCRIPTION OF THE DRAWING

A better understanding of the present invention will be had upon reference to the following detailed description, when read in conjunction with the accompanying drawing, wherein like reference characters refer to like parts throughout the several views, and in which.

DETAILED DESCRIPTION OF PREFERRED EMBODIMENTS OF THE PRESENT INVENTION

Figure 1:
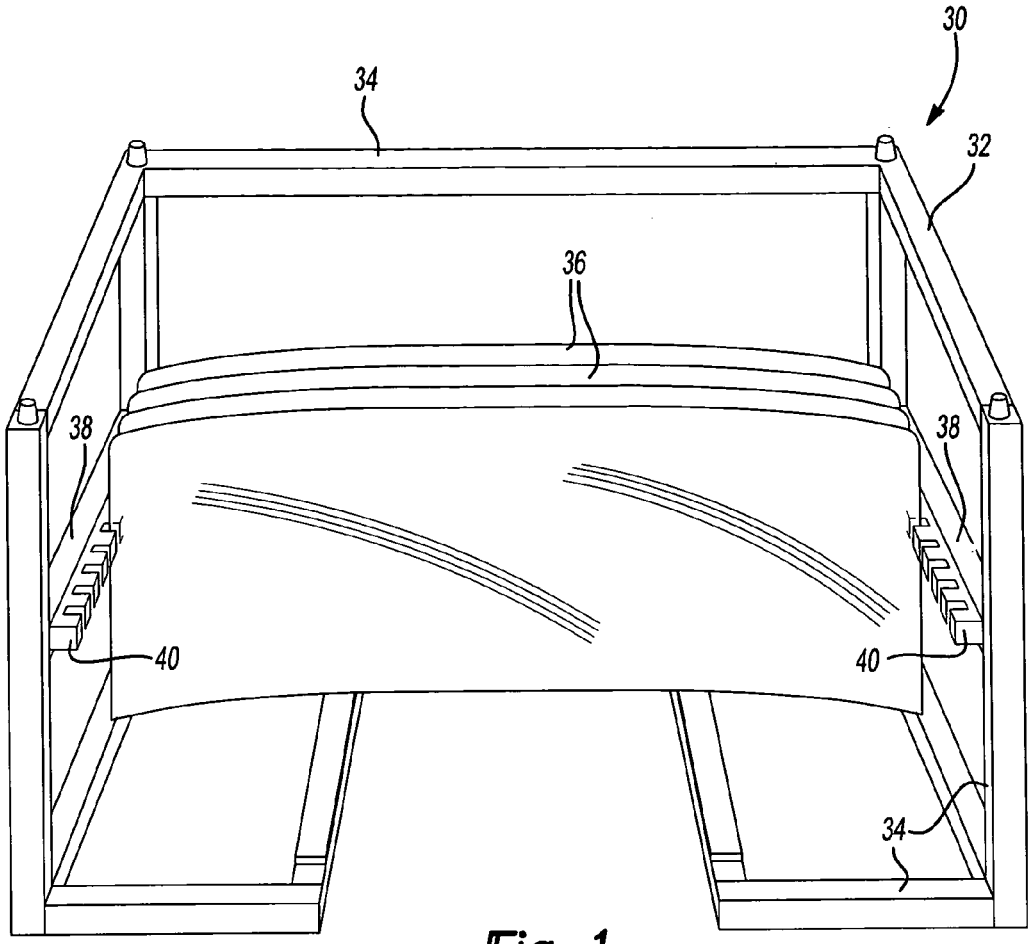
FIG. 1 is an elevational view illustrating a preferred embodiment of the shipping carrier of the present invention.
Figure 2:
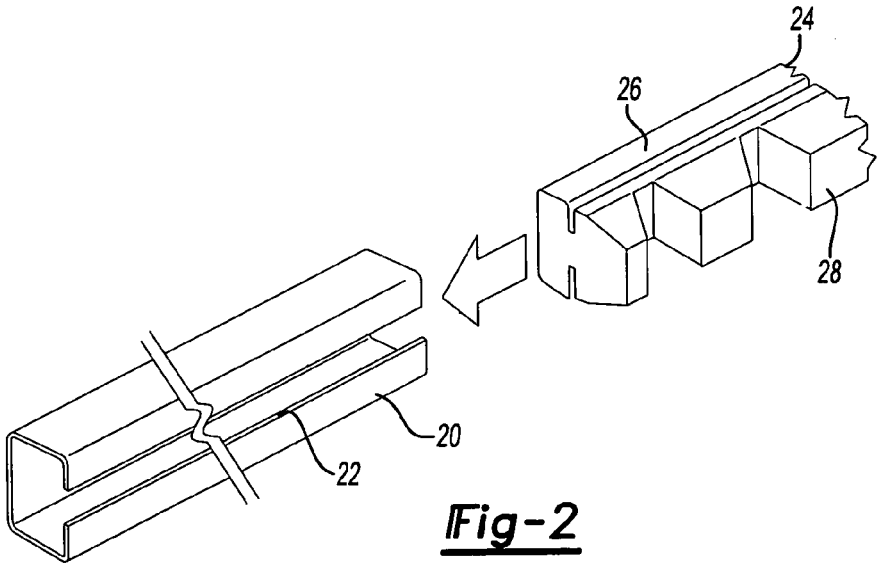
Fig-2 PRIOR ART
FIG. 2 is a fragmentary exploded view illustrating a portion of a prior art shipping carrier.

With reference first to FIG. 1, a preferred embodiment of a shipping container 30 of the present invention is shown. The shipping container 30 includes a frame 32 constructed from rectangular metal tubes 34. The metal tubes 34 are secured together to form the frame 30 in any conventional fashion, such as by welding, fasteners or the like.

The shipping container 30 is designed to carry a plurality of components 36. The components 36 are illustrated in FIG. 1 as automotive windshields. It will be understood, however, that this is by way of example only and that any type of component, automotive as well as non-automotive, may be contained and transported by the shipping container 30.

In order to support the components 36 in the carrier 30, at least one, and preferably two or more retainers 38 are secured to the frame 32 in a fashion that will be subsequently described in greater detail. In addition, each retainer 38 includes dunnage 40 which is designed for the specific transported component 36 and which also will be discussed in greater detail.

Figure 3:
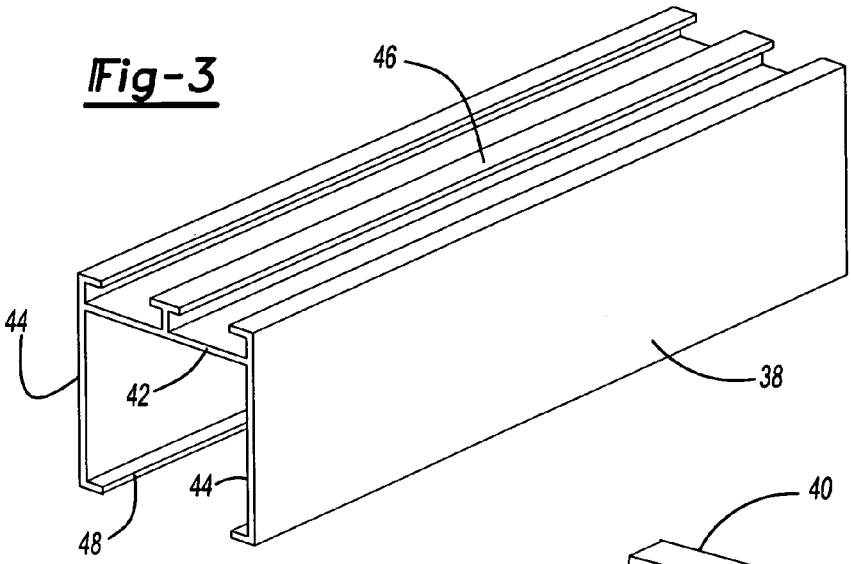
FIG. 3 is an elevational view illustrating an exemplary retainer.

With reference now to FIG. 3, an exemplary retainer 38 is illustrated. The retainer 38 preferably comprises an extrusion of a plastic material and includes an elongated main body 42. Alternatively, the retainer may be of a rolled steel construction. A pair of panels 44 extend perpendicularly outwardly from the main body 42 on opposite sides of the main body 42 so that the panels 40 are spaced apart and generally parallel to each other.

Still referring to FIG. 3, at least one, and preferably several tabs 46 protrude outwardly from the main body 42 of the retainer 38 for a reason to be subsequently described. In addition, an undercut portion 48 is preferably provided on the edge of the panels 44 most spaced from the main body 42.

Figure 4:
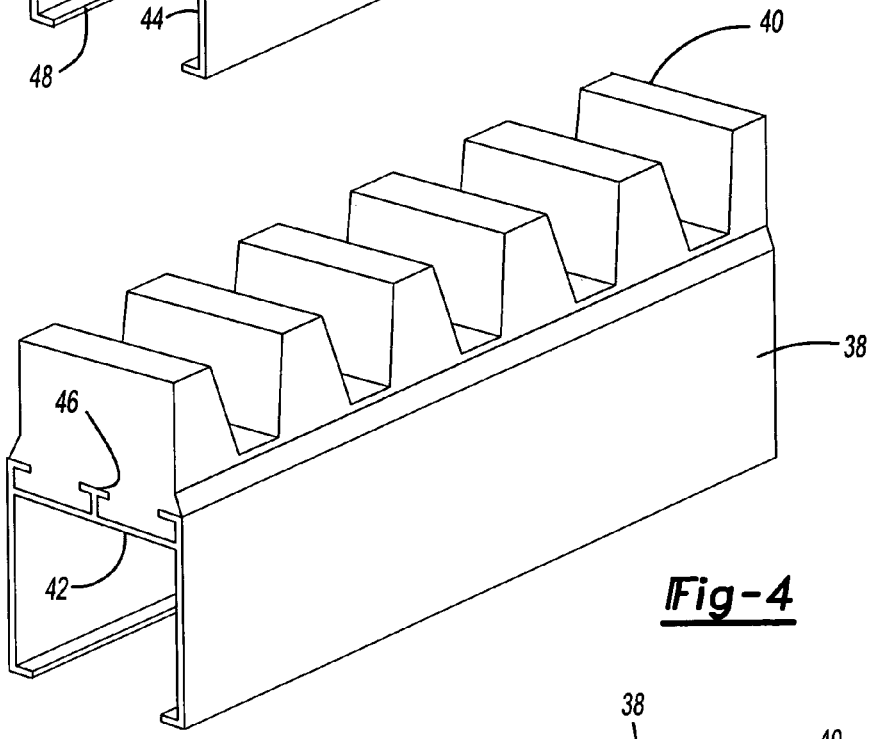
FIG. 4 is a view similar to FIG. 3, but illustrating the exemplary retainer after dunnage has been molded onto the retainer.

With reference now to FIG. 4, dunnage 40 is molded by any conventional molding method onto the main body 42 so that the dunnage 40 protrudes outwardly from the main body 42. During the molding operation, the dunnage 40 is molded around the tabs 46 thereby locking the dunnage 40 to the retainer 38.

The dunnage 40 is constructed from a flexible material, such as urethane, elastomeric materials and the like. Furthermore, it will be understood that the dunnage 40 illustrated in FIG. 4 is by way of example only. The dunnage 40 in practice is specifically designed for the type of component that will be transported by the shipping carrier 30.

Preferably, the dunnage 40 and retainer 38 form separate components. Alternatively, however, the retainer 38 and dunnage 40 are of a one-piece molded construction.

Figure 5:
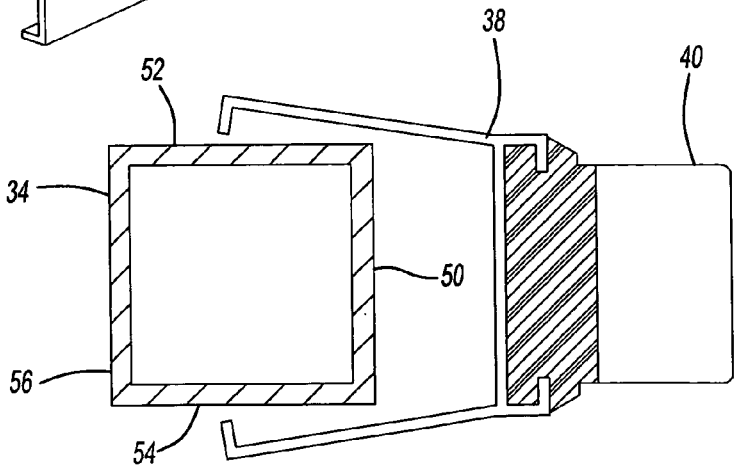
FIG. 5 is a cross-sectional view illustrating the attachment of the retainer to the frame of the shipping carrier.

With reference now to FIG. 5, the attachment of the retainer 38 with its dunnage 40 to a metal tube 34 in the frame 32 is illustrated. This metal tube 34 includes a first side 50, second and third opposed sides 52 and 54 adjacent the first side 50, and a fourth side 56 opposed to the first side 50.

Figure 6:
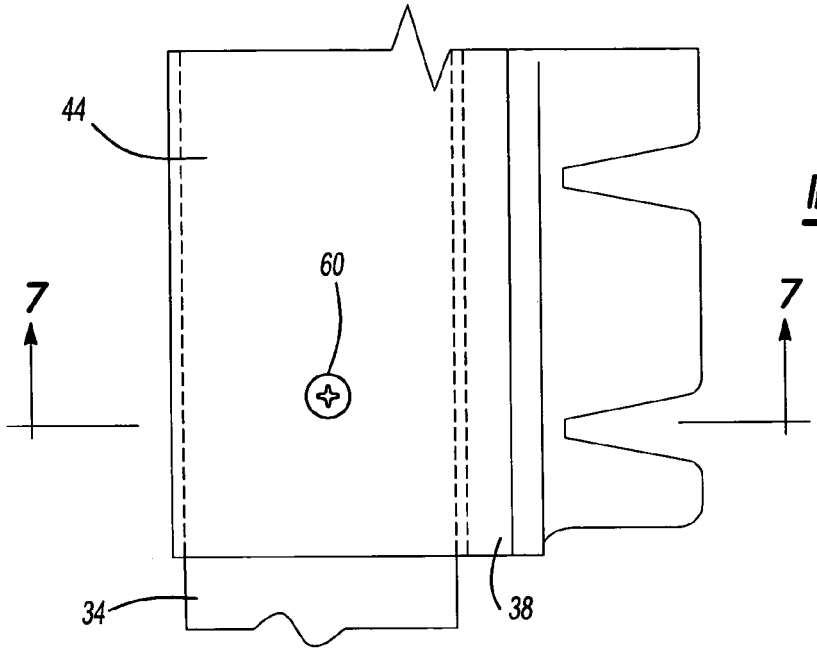
FIG. 6 is a fragmentary side view illustrating a portion of the preferred embodiment of the invention.
Figure 7:
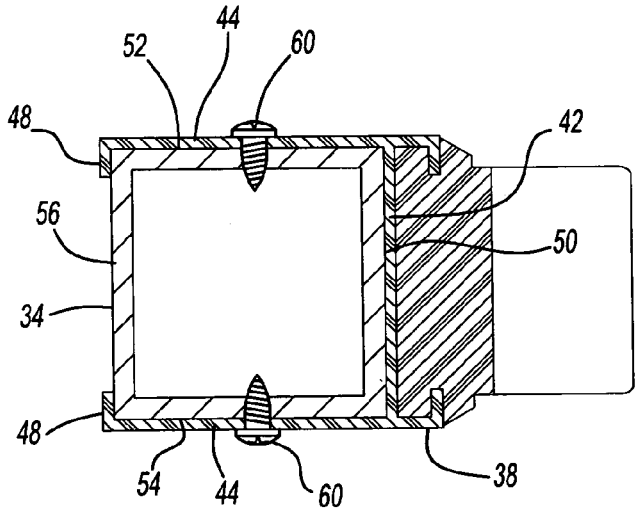
FIG. 7 is a view taken substantially along line 7—7 in FIG. 6.

With reference now to FIGS. 5–7, in order to attach the retainer 38 with its dunnage 40 to the tube 34, the retainer 38 is moved from the position shown in FIG. 5 and to the position shown in FIG. 7 by merely pushing the retainer 38 onto the metal tube 34. When the retainer is fully positioned over the metal tube 34, as shown in FIG. 7, the main body 42 of the retainer 38 is flatly positioned against the first side 50 of the metal tube 34. Additionally, the retainer 38 is dimensioned so that, with the retainer 38 positioned over the tube 34 as shown in FIG. 7, the retainer panels 44 flatly abut against the opposed second and third sides 52 and 54 of the tube 34. Additionally, the undercut portions 48 on the retainer overlie a portion of the side 56 of the tube 34 due to the resiliency of the retainer 38 thus locking the retainer 38 to the tube 34.

Referring now to FIGS. 6 and 7, in order to firmly secure the retainer 38 to the tube 34, one or more fasteners 60, such as screws or the like, may extend through the retainer panels 44 and into the metal tube 34.

Figure 8:
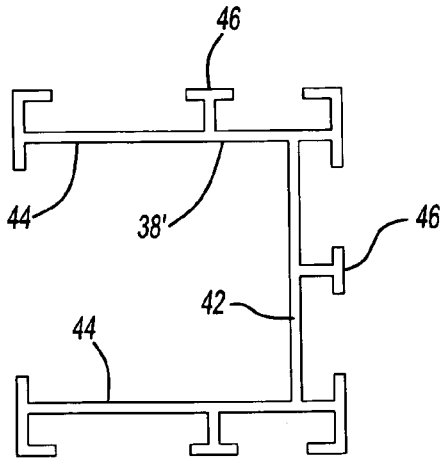
FIG. 8 is a sectional view illustrating a different type of retainer.

With reference now to FIG. 8, a second retainer 38' is illustrated having tabs 46 which protrude outwardly not only from the main body 42 of the retainer 38', but also from one or both of the retainer panels 44. Consequently, the retainer 38' may have dunnage 40 (not shown in FIG. 8) molded on two or even three sides of the retainer 38'.

Figure 9:
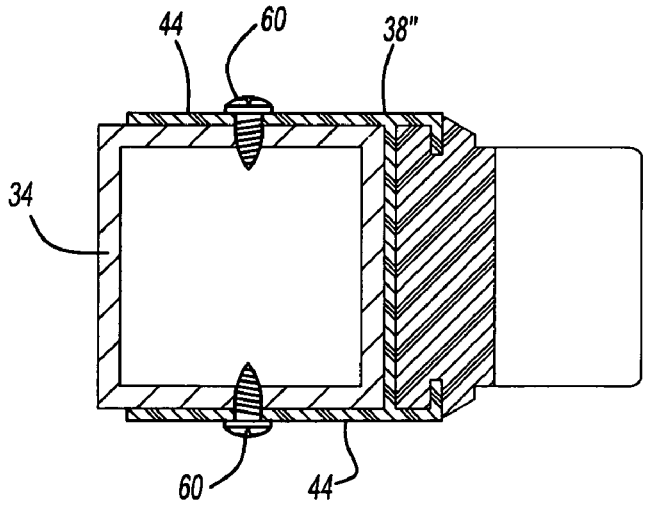
FIG. 9 is a view similar to FIG. 7, but illustrating a modification thereof.

With reference now to FIG. 9, a further modification of the retainer 38" is illustrated. The retainer 38" differs from the retainer 38 illustrated in FIG. 7 in that the retainer panels 44 do not include the undercut portions 48 (FIG. 7) to secure the retainer 38" to the metal tube 34. Instead, in FIG. 9 the retainer 38" is secured to the metal tube solely by the fasteners 60.

Figure 10:
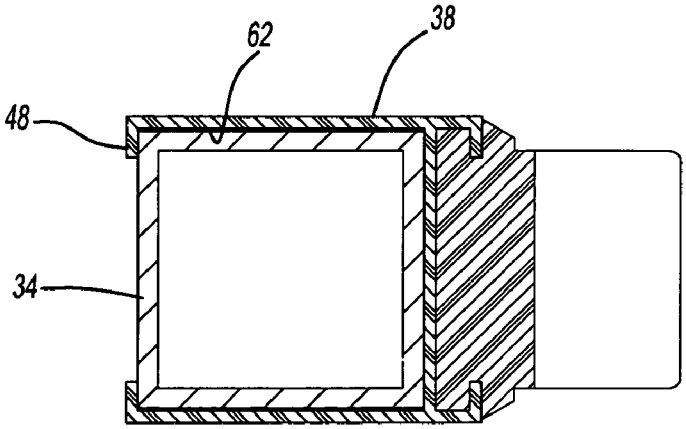
FIG. 10 is a view similar to FIG. 7, but illustrating a modification thereof.

With reference now to FIG. 10, a different method of attaching the retainer 38 to the metal tube 34 is shown. Specifically, in FIG. 10, a layer of adhesive 62 is sandwiched in between the retainer 38 and the tube 34 to secure the retainer 38 to the tube 34. The adhesively secured retainer 38 in FIG. 10 optionally includes the undercut portions 48.

Figure 11:
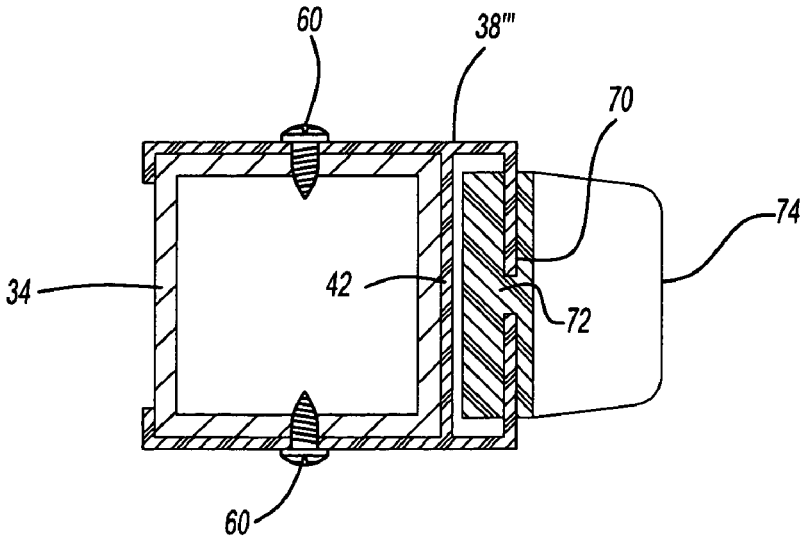
FIG. 11 is a view similar to FIG. 7, but illustrating a modification thereof.

With reference now to FIG. 11, a still further modification of the invention is illustrated in which the retainer 38'" may be secured to the tube 34 in any conventional fashion, i.e. by fasteners, an adhesive, the undercut portions and the like. The retainer 38'" differs, however, from the retainer 38 illustrated in FIG. 7 in that the retainer 38'" includes a T-slot 70 along its main body. This T-slot 70 is dimensioned to receive a T-connector 72 of a conventional retainer for shipping containers. This conventional retainer 72 also includes dunnage 74 attached to it in any conventional fashion, such as by molding the dunnage 74 to the conventional retainer 72. Consequently, the embodiment of the invention illustrated in FIG. 11 enables conventional retainers with dunnage to be easily attached to the rectangular tubing on the frame.

From the foregoing, it can be seen that the present invention provides a shipping carrier which is particularly suited for carrying components of the type used in the automotive industry. A primary advantage of the shipping carrier of the present invention is that the retainers with their attached dunnage 74 may be easily and rapidly attached to the metal tubing 34 on the carrier frame. Moreover, since the retainer with its attached dunnage is positioned wholly outside the metal tube 34, i.e. around the outer periphery of the metal tube 34, standard metal tubing having a continuous outer periphery may be used instead of the more expensive slotted metal tubing used in prior art shipping carriers.

A still further advantage of the present invention is that the retainers with their attached dunnage may be rapidly secured to the metal tubing on the carrier frame without any disassembly of the metal tube 34 from the frame as required by the previously known devices.

Having described my invention, however, many modifications thereto will become apparent to those skilled in the art to which it pertains without deviation from the spirit of the invention as defined by the scope of the appended claims.

The invention claimed is:

1. A shipping carrier comprising:

a frame having at least one elongated tube having an outer periphery, an elongated retainer having two ends, dunnage attached to said retainer and extending between said ends of said retainer, and means for attaching said retainer to said tube so that said retainer extends parallel to said tube and is positioned wholly outside said outer periphery of said tube, wherein said retainer comprises a pair of elongated planar side panels which extend between said ends of said retainer and flatly abut against said outer periphery of said tube, and wherein said tube is rectangular in cross-sectional shape and wherein said retainer panels flatly abut against said outer periphery of said tube on opposed sides of said tube so that said dunnage extends along and parallel to said tube.

2. The invention as defined in claim 1 wherein said tube comprises a rectangular metal tube.

3. The invention as defined in claim 2 wherein said outer periphery of said tube comprises a continuous surface.

4. The invention as defined in claim 1 wherein said attaching means comprises a fastener extending through said retainer and into said tube.

5. The invention as defined in claim 4 wherein said fastener comprises a screw.

6. The invention as defined in claim 1 wherein said fastening means comprises an adhesive disposed between said retainer and said outer periphery of said tube.

7. The invention as defined in claim 1 wherein said retainer is constructed of a plastic material.

8. The invention as defined in claim 1 wherein said dunnage is molded onto said retainer.

9. The invention as defined in claim 8 wherein said dunnage comprises a urethane.

10. The invention as defined in claim 8 wherein said dunnage comprises an elastomeric material.

11. The invention as defined in claim 8 wherein said retainer includes at least one outwardly protruding tab round which said dunnage is molded.

12. The invention as defined in claim 1 wherein said retainer includes a longitudinally extending elongated T-slot and where said dunnage includes a T-member dimensioned to be received in said T-slot.

13. The invention as defined in claim 1 wherein said retainer and said dunnage comprise a one-piece molded construction.

14. The invention as defined in claim 1 wherein said retainer comprises a rolled steel construction.

15. A shipping carrier comprising:

a frame having at least one elongated tube having an outer periphery, an elongated retainer having two ends, dunnage attached to said retainer and extends between said ends of said retainer, and means for attaching said retainer to said tube so that said retainer extends parallel to and is positioned wholly outside said outer periphery of said tube, wherein said tube is rectangular in cross-sectional shape and wherein said retainer comprises an elongated main body having a pair of spaced apart panels extending between the ends of said retainer extending perpendicularly outwardly from opposite edges of said main body, said main body and said panels being dimensioned so that said main body abuts against a first side of said tube while said panels abut against second and third sides of said tube, said second and third sides of said tube being adjacent to said first side and opposed to each other.

16. The invention as defined in claim 15 wherein said retainer is constructed of a flexible material and wherein said means for attaching comprises an undercut portion on each retainer panel, said undercut portions overlying a fourth side of said tube.

17. A shipping carrier comprising:

a frame having at least one elongated tube having an outer periphery, an elongated retainer, dunnage attached to said retainer, and means for attaching said retainer to said tube so that said retainer is positioned wholly outside said outer periphery of said tube, wherein said retainer comprises a pair of side panels which flatly abut against said outer periphery of said tube at peripherally spaced positions on said tube, and wherein said tube is rectangular in cross-sectional shape and wherein said retainer panels flatly abut against said outer periphery of said tube on opposed sides of said tube, wherein said retainer is constructed of a flexible material and wherein said means for attaching comprises an undercut portion on each retainer panel, said undercut portions overlying a fourth side of said tube.

* * * * *